US007904007B2

(12) United States Patent
Takesue et al.

(10) Patent No.: US 7,904,007 B2
(45) Date of Patent: Mar. 8, 2011

(54) DEVELOPER STORAGE CONTAINER AND IMAGE FORMING APPARATUS

(75) Inventors: Yuichiro Takesue, Ikoma (JP); Takeshi Ohkawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 694 days.

(21) Appl. No.: 11/930,665

(22) Filed: Oct. 31, 2007

(65) Prior Publication Data

US 2008/0118278 A1 May 22, 2008

(30) Foreign Application Priority Data

Nov. 20, 2006 (JP) ..... 2006-313584

(51) Int. Cl.
*G03G 15/08* (2006.01)

(52) U.S. Cl. ..... 399/263

(58) Field of Classification Search ..... 399/120, 399/263

See application file for complete search history.

(56) References Cited

U.S. PATENT DOCUMENTS

| | | | |
|---|---|---|---|
| 5,235,389 | A | 8/1993 | Kikuchi et al. |
| 5,774,772 | A | 6/1998 | Kai et al. |
| 6,766,134 | B2 | 7/2004 | Nakamura |

FOREIGN PATENT DOCUMENTS

| | | | |
|---|---|---|---|
| JP | 3-288875 | | 12/1991 |
| JP | 04-100074 | | 4/1992 |
| JP | 4-100074 | | 4/1992 |
| JP | 10-149006 | A | 6/1998 |
| JP | 10-213957 | A | 8/1998 |
| JP | 10-247009 | | 9/1998 |
| JP | 11-15273 | A | 1/1999 |
| JP | 2003-131534 | | 5/2003 |
| JP | 2003-140452 | | 5/2003 |

*Primary Examiner* — David M Gray
*Assistant Examiner* — Andrew V Do
(74) *Attorney, Agent, or Firm* — Nixon & Vanderhye, PC

(57) ABSTRACT

A toner cartridge is a developer storage container for storing toner (developer) in a hollow cylindrical section that is driven to rotate on its axis so that the stored toner is discharged from an outlet. The cylindrical section has an inner circumferential surface provided with a plurality of liner protruding portions that extend in a direction tilted with respect to a rotation direction of the cylindrical section. Moreover, the toner cartridge includes a stirring member capable of moving in the cylindrical section so as to collide with the protruding portions. This makes it possible to stably supply a developer and to realize an inexpensive developer storage container whose size can be reduced.

20 Claims, 17 Drawing Sheets

DEVELOPER STORAGE CONTAINER AND IMAGE FORMING APPARATUS

This Nonprovisional application claims priority under 35 U.S.C. §119(a) on Patent Application No. 313584/2006 filed in Japan on Nov. 20, 2006, the entire contents of which are hereby incorporated by reference.

FIELD OF THE TECHNOLOGY

The present technology relates to developer storage containers in which developers are stored. Particularly, the technology relates to a developer storage container that is driven to rotate so that a developer stored in the developer storage container is discharged.

BACKGROUND OF THE TECHNOLOGY

In an electrophotographic image forming apparatus, an electrostatic latent image formed on a surface of a photoreceptor is developed with toner by a developing device. The toner with which the electrostatic latent image is developed is stored in a toner cartridge equivalent to a developer storage container, and is sequentially supplied from the toner cartridge to the developing device.

In many cases, the toner cartridge is shaped into a hollow cylinder, and has one end that is closed and the other end near which an outlet is provided. When the toner cartridge is mounted in the image forming apparatus, the toner cartridge is disposed so that the cylindrical section has a horizontal axis. Moreover, when the toner cartridge is driven to rotate on its axis, the stored toner is stirred, and then is conveyed toward the outlet. As a result, the toner is discharged from the outlet in an amount corresponding to the rotation.

In recent years, a large number of toner cartridges have been proposed as a toner cartridge of a full-color multifunctional apparatus from the standpoint of simplicity in handling and recycling.

However, in recent years, toner has been made to include smaller particles for the purpose of higher-quality images. This has caused the toner to have a lower fluidity, and to easily adhere to the inner wall of a toner cartridge. In response to these negative effects, it is necessary to smoothly and stably supply the total amount of toner.

In view of this, Japanese Unexamined Patent Application Publication No. 288875/1991 (Tokukaihei 3-288875; published on Dec. 19, 1991) (hereinafter referred to as "Patent Document 1") discloses a technique of scraping toner adhering to the inner wall of a toner cartridge, surely stirring the total amount of toner contained in the toner cartridge, and enabling the toner to be discharged. According to this technique, the toner cartridge has a rotatable spiral stirring member provided therein.

Further, Japanese Unexamined Patent Application Publication No. 100074/1992 (Tokukaihei 4-100074; published on Apr. 2, 1992) (hereinafter referred to as "Patent Document 2") discloses a technique of removing toner from the inner wall of a pipe with vibration so as to prevent the toner from remaining in the inner side of the pipe. According to this technique, a developer container is provided with a blender in which spiral wings wound in opposite directions are respectively provided on the inner and outer sides of the pipe, and a spherical member is provided on the inner side of the pipe.

Japanese Unexamined Patent Application Publication No. 131534/2003 (Tokukai 2003-131534; published on May 9, 2003) (hereinafter referred to as "Patent Document 3") discloses a technique. According to this technique, a conveyer screw for conveying toner is provided in a residual toner recovery device, and a spherical body for preventing the toner from accumulating is provided on the conveyer screw.

However, according to the techniques of Patent Documents 1 and 2, the stirring member and spiral wings each equivalent to stirring means provided in a toner cartridge have complex structures, and the increase in the number of parts for rotating the stirring member and spiral wings incurs greater costs. The technique of Patent Document 3 causes a similar problem because the conveyer screw for conveying toner has a complex structure. Further, the complex structure of a conveying mechanism causes an increase in the number of parts, thereby causing an increase in size of a toner cartridge. This causes an increase in size of a full-color multifunctional apparatus in which toner cartridges corresponding to four colors Y, M, C, and K are stored. This makes it impossible to satisfy the market need for space saving.

SUMMARY OF THE TECHNOLOGY

It is an object of the technology to provide an inexpensive developer storage container which can stably supply a developer and whose size can be reduced.

In order to attain the foregoing object, a developer storage container is a developer storage container storing a developer in a hollow cylindrical section that is driven to rotate on an axis thereof so that the stored developer is discharged from an outlet, the cylindrical section having an inner circumferential surface provided with a plurality of liner protruding portions that extend in a direction tilted with respect to a rotation direction of the cylindrical section, the developer storage container comprising at least one stirring member capable of moving in the cylindrical section so as to collide with the protruding portions.

According to the foregoing arrangement, the cylindrical section has an inner circumferential surface provided with a plurality of liner protruding portions that extend in a direction tilted with respect to a rotation direction of the cylindrical section. Therefore, the rotation of the cylindrical section causes the developer to be conveyed. Moreover, there exists at least one stirring member capable of moving in the cylindrical section so as to collide with the protruding portions. Therefore, the rotation of the cylindrical section causes the at least one stirring member to vibrate the developer storage container by colliding with the protruding portions. The vibration causes the toner to be removed from an inner wall of the cylindrical section. This makes it possible to improve efficiency in the discharge of the developer. Further, the at least one stirring member can move in the cylindrical section. Therefore, the rotation of the cylindrical section causes the at least one vibrating member to rub the inner wall of the cylindrical section in a region free of protruding portions. This also makes it possible to remove the developer from the inner wall, thereby improving efficiency in the discharge of the developer.

Moreover, the developer storage container thus arranged has such a simple structure that the inner circumferential surface of the cylindrical section is provided with the linear protruding portions and the cylindrical section includes the at least one stirring member. That is, unlike the conventional arrangements, the developer storage container does not require a rotatable spiral stirring member, a part for rotating the stirring member, and the like in addition to the cylindrical section. This makes it possible to manufacture the developer storage container inexpensively. Further, such a simple structure makes it possible to achieve a reduction in size of the developer storage container.

As described above, the technology makes it possible to stably supply a developer and to realize an inexpensive developer storage container whose size can be reduced.

Additional objects, features, and strengths of the technology will be made clear by the description below. Further, the advantages of the technology will be evident from the following explanation in reference to the drawings.

BRIEF DESCRIPTION OF THE DRAWINGS

FIG. 13(*b*) is a cross-sectional view of the toner cartridge taken along the arrow A of FIG. 13(*a*).

FIG. 14(*b*) is a cross-sectional view of the toner cartridge taken along the arrow B of FIG. 14(*a*).

FIG. 15(*b*) is a cross-sectional view of the toner cartridge taken along the arrow C of FIG. 15(*a*).

FIG. 16(*b*) is a cross-sectional view of the toner cartridge taken along the arrow D of FIG. 16(*a*).

DESCRIPTION OF THE EMBODIMENTS

An embodiment of the technology will be described below with reference to FIGS. 1 through 17.

(Overall Structure of a Multifunctional Apparatus)

Figure 2:
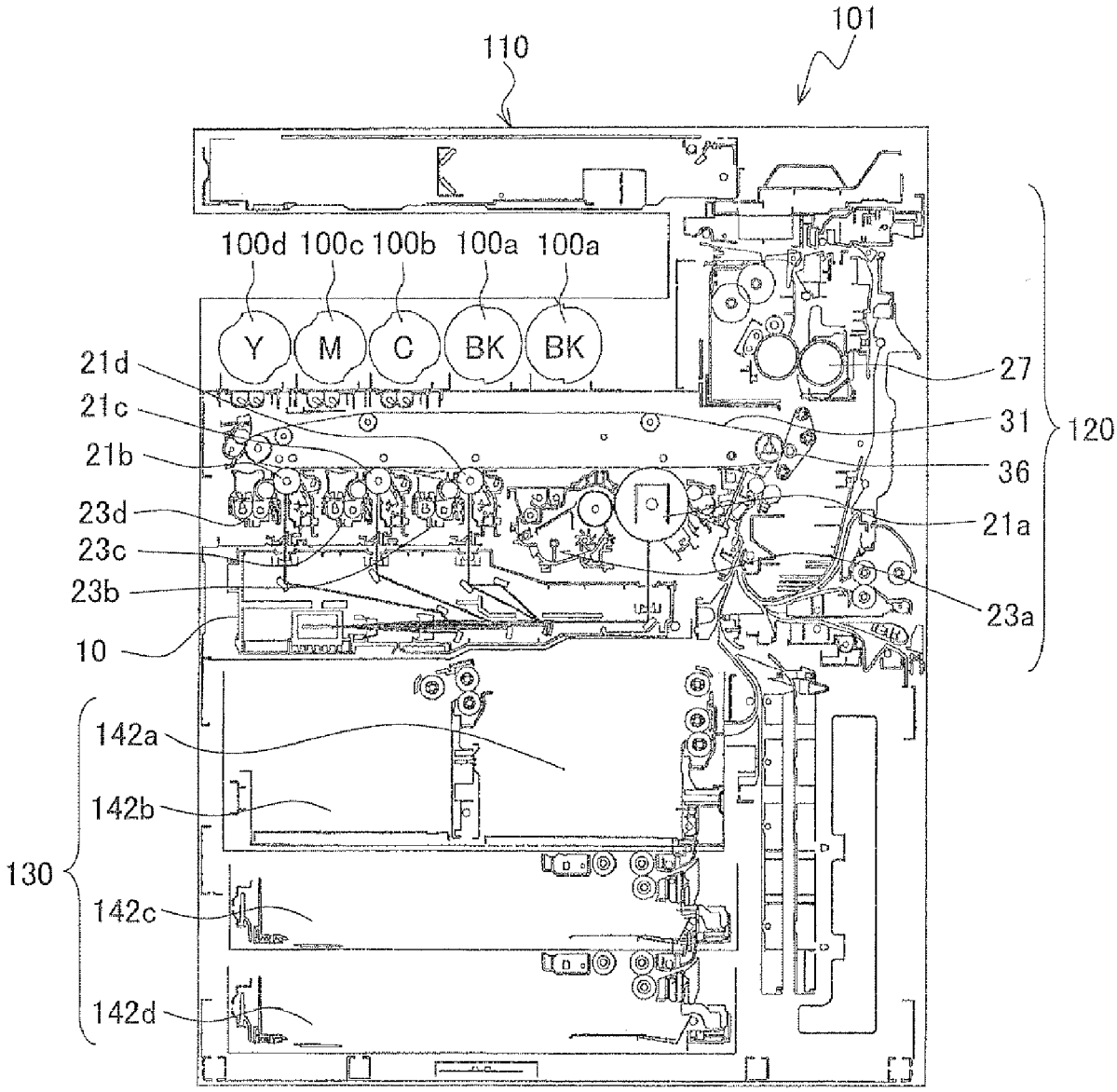
FIG. 2 is a traverse sectional view schematically showing a structure of a multifunctional apparatus.

FIG. 2 is a traverse sectional view schematically showing a structure of a multifunctional apparatus. In the present embodiment, an image forming apparatus is explained by taking the multifunctional apparatus as an example. However, the technology is not limited to this, and encompasses image forming apparatuses such as printers, fax machines, and copiers.

The multifunctional apparatus 101 of the present embodiment electrophotographically forms a multicolor or monochrome image on a recording paper sheet in accordance with a print job sent from an information processing apparatus such as an external personal computer with or without wires, or in accordance with image data obtained by scanning a document with use of a document reading unit.

As shown in FIG. 2, the multifunctional apparatus 101 is composed mainly of a document reading unit 110, an image forming unit 120, and a paper feeding unit 130. The paper feeding unit 130 has four paper sheet cassettes 142*a* to 142*d* in which paper sheets are stored. The image forming unit 120 forms an image by a Carlson process on a recoding paper sheet fed from any one of the paper sheet cassettes. The document reading unit 110 creates image data by scanning a document placed on a document table.

More specifically, the image forming unit 120 forms a multicolor image by superimposing a black (BK) toner image, a cyan (C) toner image, a magenta (M) toner image, and a yellow (Y) toner image onto one another. For this purpose, the image forming unit 120 includes four photoreceptor drums 21*a* to 21*d*, respectively corresponding to BK, C, M, and Y, around each of which a charging device, a developing device, a transfer roller, and a cleaning member are provided. Thus, the image forming unit 120 serves as a tandem color image forming unit.

The image forming unit 120 further includes an exposure unit 10, an intermediate transfer belt 31, a transfer roller 36, a fixing device 27, and the like.

Each of the photoreceptor drums 21*a* to 21*d* is an organic photoreceptor obtained with use of an organic photo conductor (OPC).

The exposure unit 10 has a laser scanning unit, a polygonal mirror, an fθ lens, reflecting mirrors, and the like. In the exposure unit 10, a laser beam emitted from the laser scanning unit is separated into laser beams having different colors, and then the laser beams are reflected by the reflecting mirrors so as to be sent upon the photoreceptor drums 21*a* to 21*d*, respectively.

Each of the developing devices 23*a* to 23*d* has a developer tank, a stirring roller, a developing roller, a doctor blade, and the like. Each of the developing devices 23*a* to 23*d* develops an image with use of a two-component developer prepared by mixing carrier with toner. Each of the developing devices 23*a* to 23*d* develops an image (i) by using the stirring roller to mix carrier with toner supplied into the developer tank, (ii) by forming, on the developing roller, a magnetic brush whose height of hairs has been appropriately adjusted by the doctor blade, and then (iii) by causing the magnetic brush to make contact with a corresponding one of the photoreceptor drums 21*a* to 21*d* under a developing bias.

In order to supply black (BK) toner, cyan (C) toner, magenta (M) toner, and yellow toner (Y) to the developing devices 23*a* to 23*d*, respectively, the multifunctional apparatus 101 has toner supply devices 100*a* to 100*d* respectively located above the developing devices 23*a* to 23*d*. The toner supply devices 100*a* to 100*d* have toner cartridges in which the black toner, the cyan toner, the magenta toner, and the yellow toner (Y) are stored, respectively. Each of the toner cartridges can be replaced when it runs out of toner. Note that the multifunctional apparatus 101 has two toner supply devices 100*a* both corresponding to the black toner, which is consumed in large amounts. Further, each of the respective toner cartridges of the toner supply devices 100*a* to 100*d* may contain an appropriate amount of carrier in addition to the corresponding toner.

The intermediate transfer belt 31 is an endless belt stretched by a driving roller and a driven roller, and makes contact with respective surfaces of the photoreceptor drums 21*a* to 21*d*. Further, the intermediate transfer belt 31 also makes contact with a paper sheet conveying path. The transfer roller 36 is provided in a place of contact between the intermediate transfer belt 31 and the paper sheet conveying path so as to face the intermediate transfer belt 31.

The fixing device 27 has a fixing roller and a pressure roller. When a recording paper sheet onto which a toner image has been transferred is sandwiched between these two rollers, the toner image is fixed onto the recording paper sheet.

The following explains a process of forming an image in the multifunctional apparatus 101.

First, the surfaces of the photoreceptor drums 21*a* to 21*d* are uniformly charged by the charging devices, respectively. Next, when those regions of the surfaces of the photoreceptor drums 21*a* to 21*d* which have been uniformly charged is exposed to light by the exposure unit 10, electrostatic latent images are formed on the surfaces of the photoreceptor drums 21*a* to 21*d*, respectively. These electrostatic latent images are created so as to respectively correspond to color components contained in the image.

Then, the electrostatic latent images formed on the surfaces of the photoreceptor drums 21*a* to 21*d* so as to correspond to the color components are developed by the developing devices 23*a* to 23*d*, respectively. This causes a black (BK) toner image, a cyan (C) toner image, a magenta (M) toner image, and a yellow (Y) toner image to be formed on the surfaces of the photoreceptor drums 21*a* to 21*d*, respectively. The toner images formed on the surfaces of the photoreceptor drums 21*a* to 21*d* respectively are transferred onto the intermediate transfer belt 31 so as to be superimposed onto one another. This causes the desired multicolor image to be formed as a toner image on the intermediate transfer belt 31.

Meanwhile, a recording paper sheet is picked up from any one of the paper sheet cassettes of the paper feeding unit 130, and then is conveyed through the paper sheet conveying path. The recording paper sheet thus conveyed reaches a point at which the transfer belt 36 is provided, and then is pressed against the intermediate transfer belt 31 by the transfer roller 36. It should be noted here that a transfer electric field is formed between the transfer roller 36 and the intermediate transfer belt 31, and that this electric field has such an effect that the toner image formed on the intermediate transfer belt 31 is transferred onto the recording paper sheet.

The recording paper sheet onto which the toner image has been transferred is further conveyed, and the toner image is fixed onto the recording paper sheet by the fixing device 27. Then, the recording paper sheet is ejected onto a paper ejection tray. This is the end of the image forming process.

(Structures of the Developing Devices and Toner Supply Devices)

The following fully explains respective structures of the developing devices 23*a* to 23*d* and toner supply devices 100*a* to 100*d* of the present embodiment.

Figure 3:
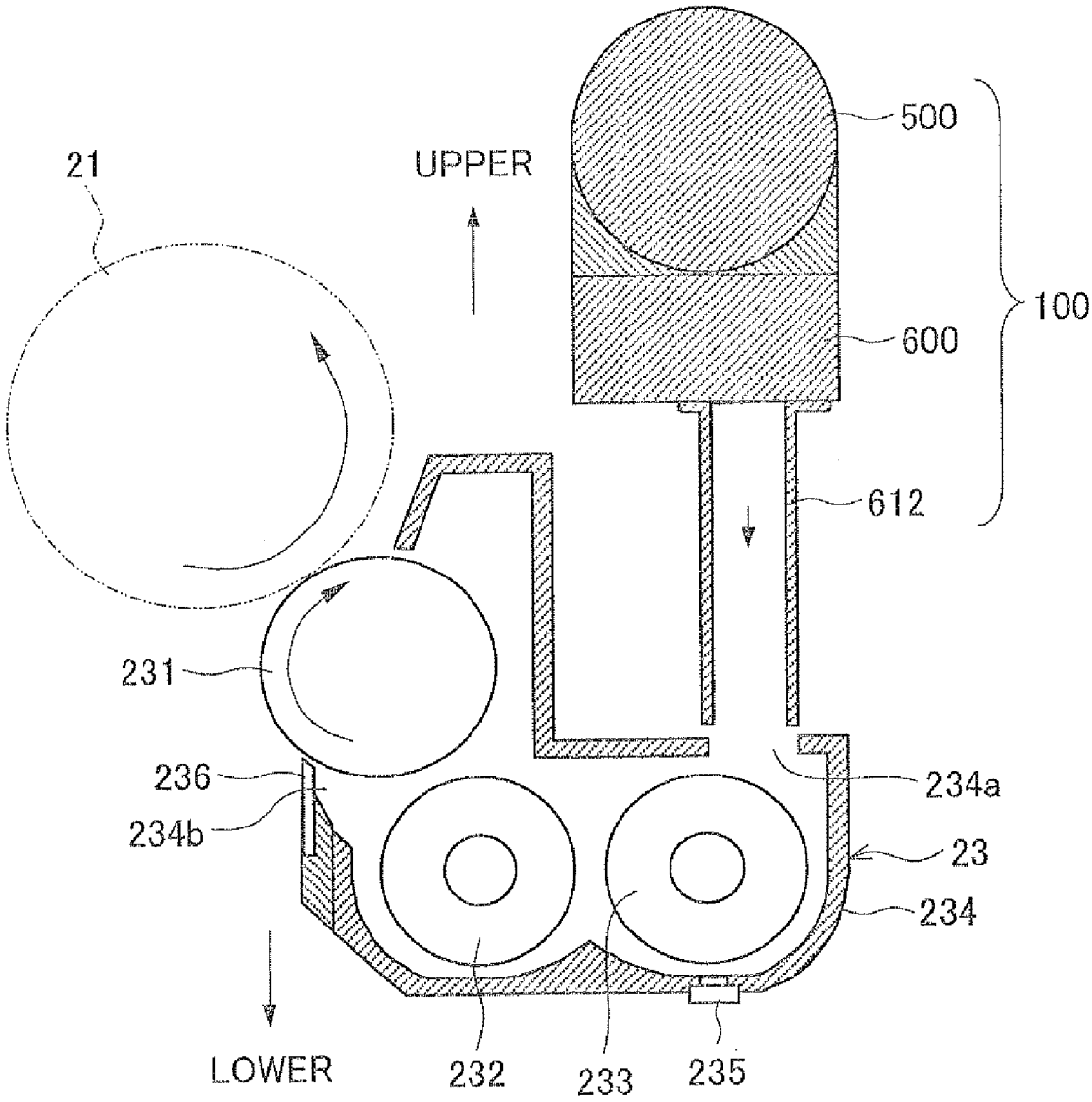
FIG. 3 is a traverse sectional view schematically showing respective structures of a developing device and a toner supply device.

The developing devices 23*a* to 23*d* basically have the same structure; therefore, the developing devices 23*a* to 23*d* are referred to collectively as "developing device 23". The same applies to the toner supply devices 100*a* to 100*d*; therefore, the toner supply devices 100*a* to 100*d* are referred to collectively as "toner supply device 100". FIG. 3 is a traverse sectional view schematically showing respective structures of the developing device 23 and the toner supply device 100.

As shown in FIG. 3, the developing device 23 has a developing roller 231, a first toner conveying roller 232, a second toner conveying roller 233, a toner tank 234, a toner density sensor 235, and a doctor blade 236.

The toner tank 234 serves as an outer covering, and has an upper portion provided with an opening serving as a toner inlet 234*a* through which a developer is introduced. Further, the toner tank 234 has an opening portion 234*b* provided so as to face a photoreceptor drum. Provided in the toner tank 234 are the developing roller 231, the first toner conveying rollers 232, and the second toner conveying roller 233.

The developing roller 231 is provided near the opening portion 234*b* provided in the toner tank 234. The developing roller 231 is exposed from the opening 234*b* so as to make contact with or be adjacent to the photoreceptor drum 21. The developing roller 231 serves as a magnet roller by which the aforementioned magnetic brush is formed.

The first toner conveying roller 232 and the second toner conveying roller 233 are disposed at the bottom of the toner tank 234 so as to be parallel with the developing roller 231, and convey toner from the toner tank 234 to the developing roller 231 while stirring the toner together with carrier in the toner tank 234. Further, at the bottom of the toner tank 234, the toner density sensor 235 is provided. The toner density sensor 235 is a magnetic permeability sensor that detects the proportion of the toner to the carrier in the toner tank 234.

Provided above the developing device 23 thus arranged is the toner supply device 100. As shown in FIG. 3, the toner supply device 100 is composed mainly of a toner supply section 500 for supplying toner, a supporting member 600 for supporting the toner supply section 500, a toner conveying path 612 through which the toner is guided from the toner supply section 500 to the developing device 23, and a driving motor (not shown).

Figure 4:
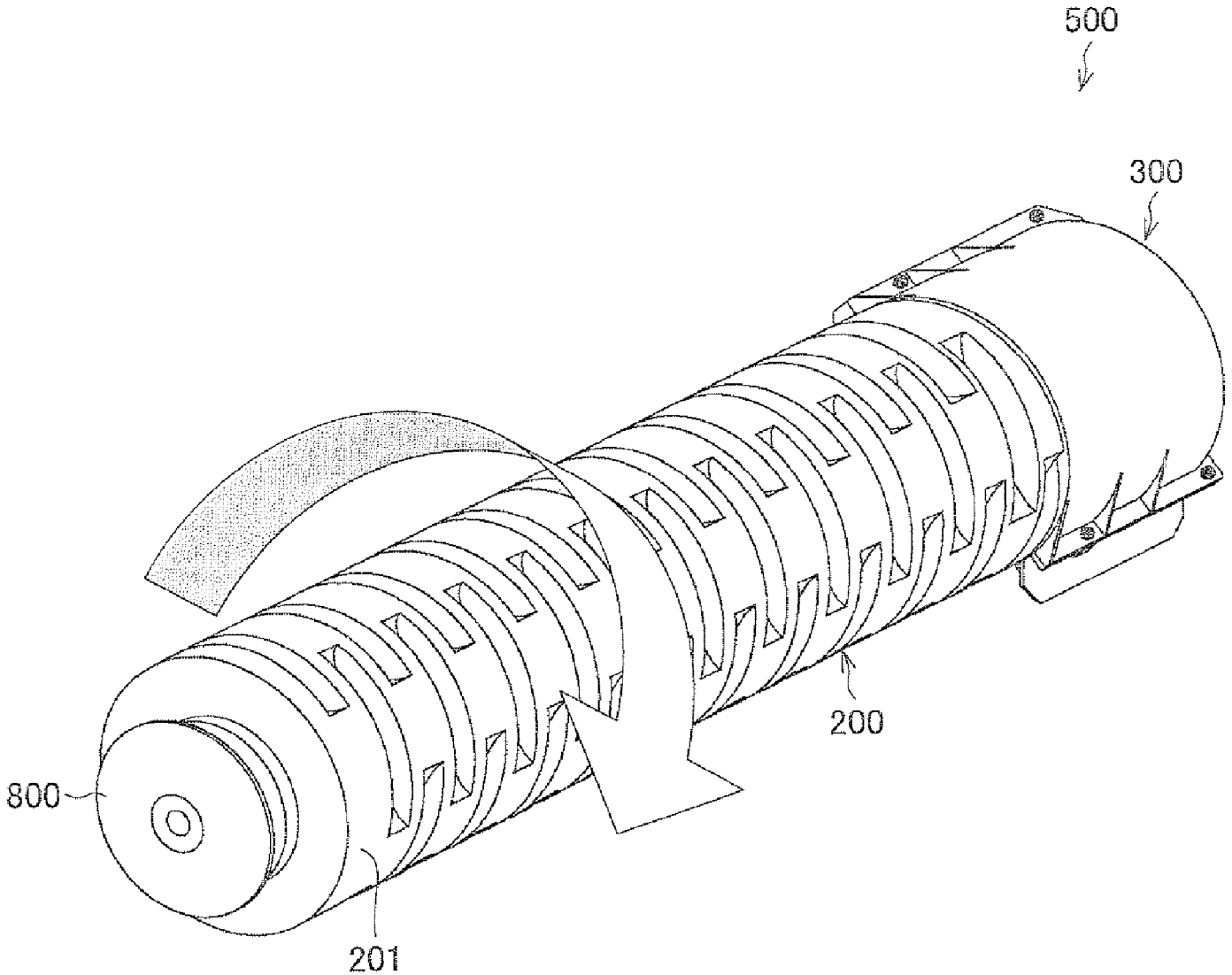
FIG. 4 is a perspective view showing a structure of the toner supply section.
Figure 5:
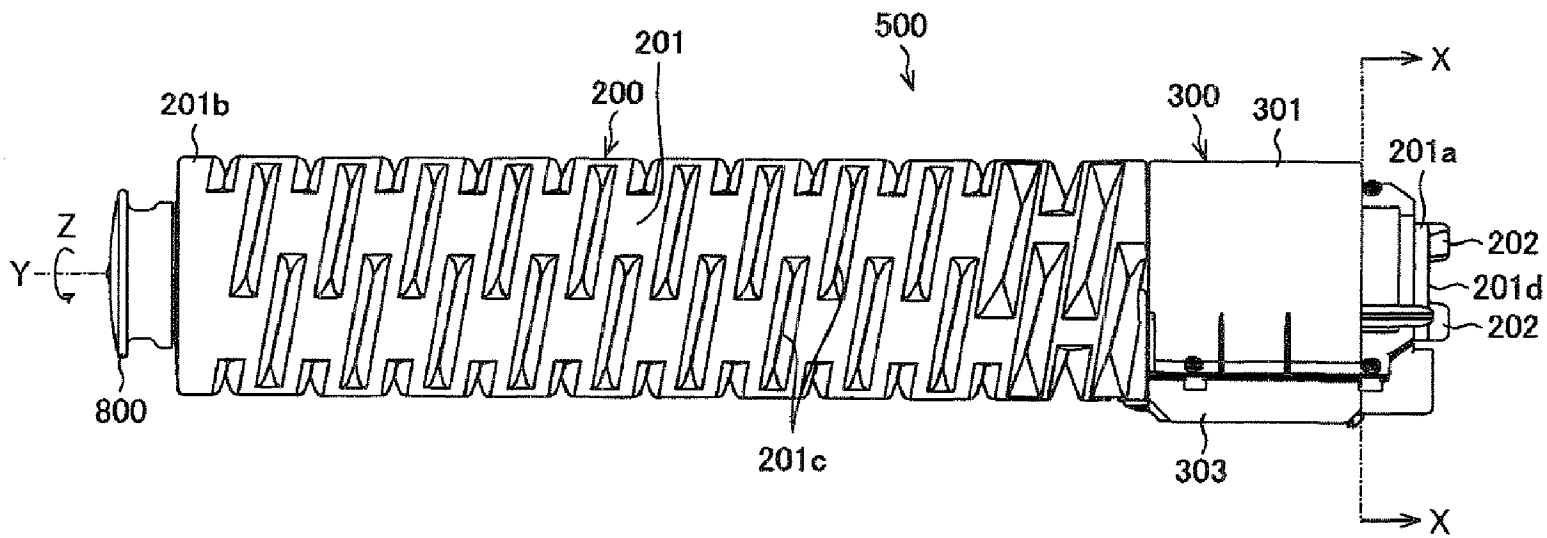
FIG. 5 is a right-side view showing the structure of the toner supply section.
Figure 6:
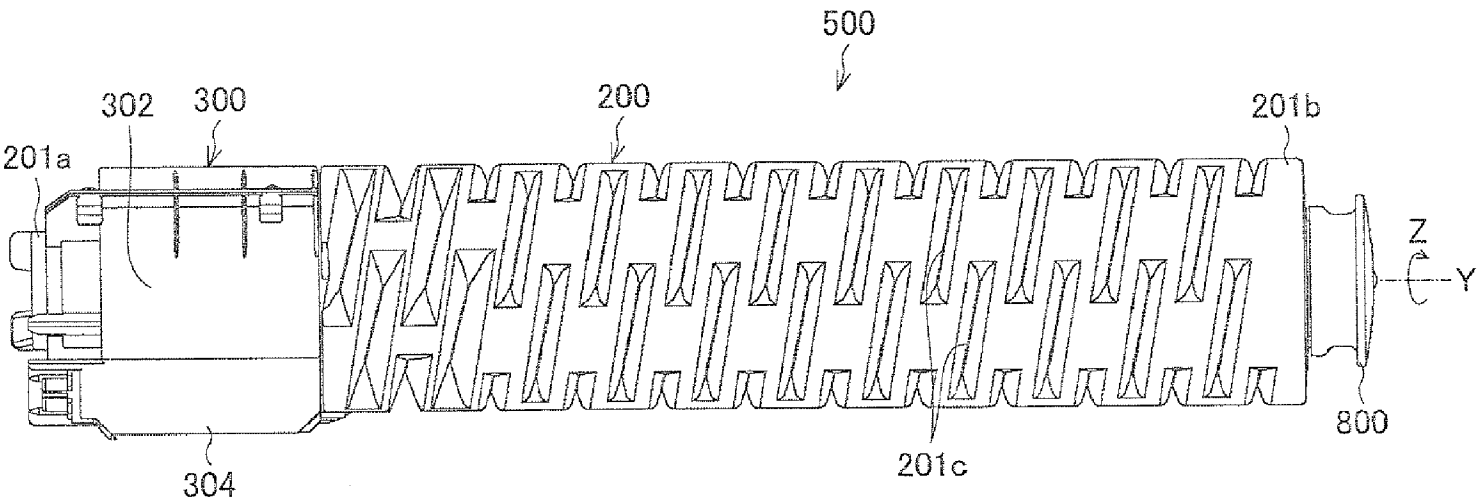
FIG. 6 is a left-side view of the toner supply section.
Figure 7:
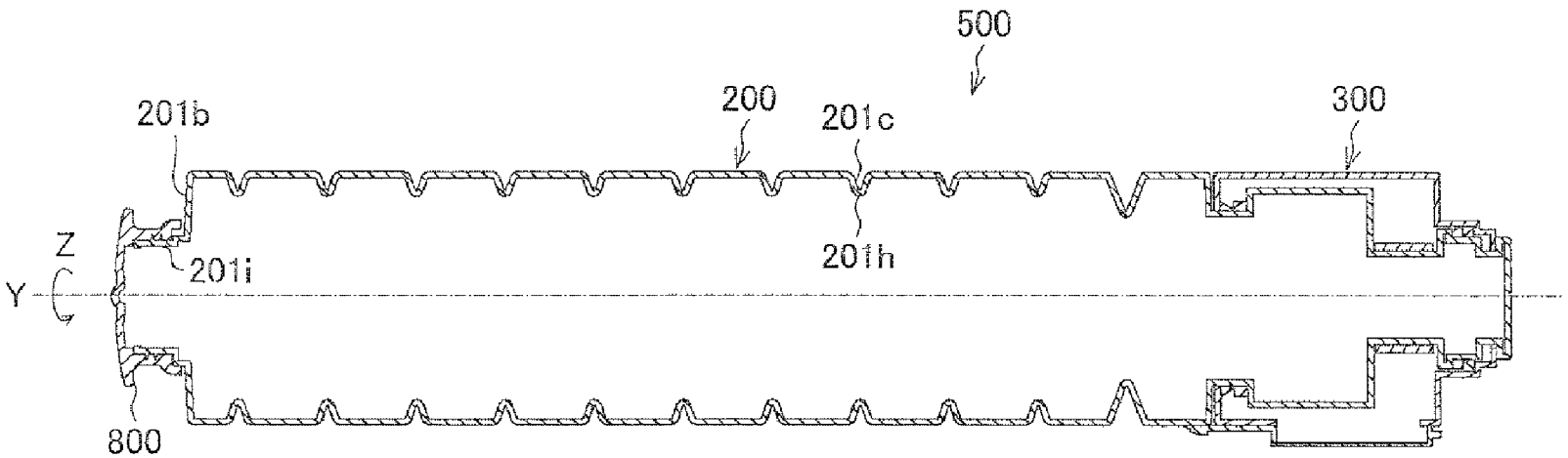
FIG. 7 is a cross-sectional view of the toner supply section of FIG. 4.
Figure 8:
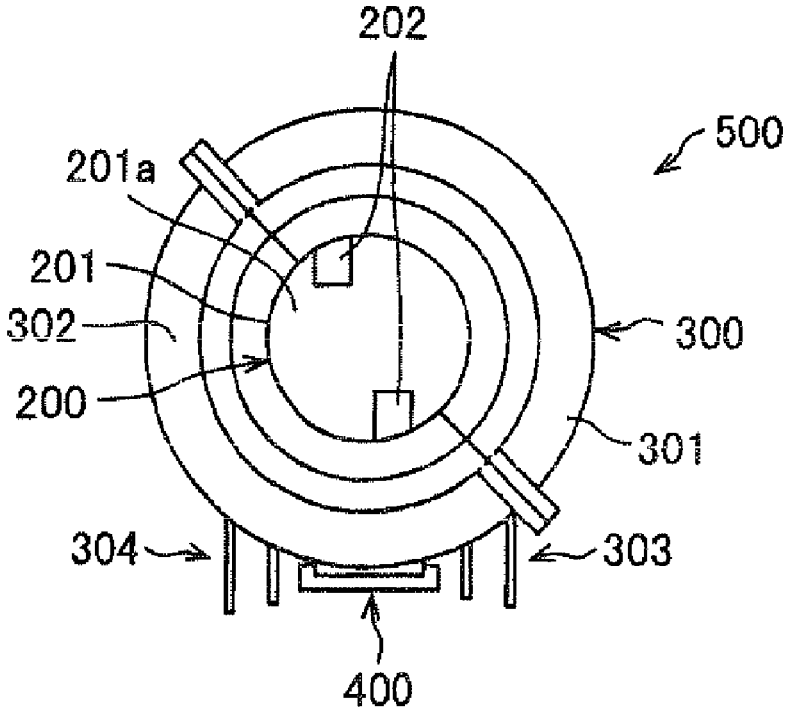
FIG. 8 is a cross-sectional view of the toner supply section of FIG. 5 taken along the arrow X.

FIG. 4 is a perspective view of a structure of the toner supply section 500. Further, FIG. 5 is a right-side view of the toner supply section 500. FIG. 6 is a side view of the reverse side of the toner supply section 500 of FIG. 5. FIG. 7 is a cross-sectional view of the toner supply section 500 taken along the axis Y. Note that although the present embodiment has vibrating members (to be mentioned later) provided in the toner supply section, FIG. 7 does not show such a vibrating member. Furthermore, FIG. 8 is a cross-sectional view of the toner supply section 500 of FIG. 5 taken along the arrow X.

As shown in FIGS. 4 through 7, the toner supply section 500 has a toner cartridge (developer storage container) 200 in which toner serving as a developer is stored and a holding member 300 rotatably holding an end of the toner cartridge 200.

The toner cartridge 200 has a cylindrical section 201 having a substantially cylindrical shape. The cylindrical section 201 has a top end portion 201*a* that is to be held by the holding member 300. Provided near the top end portion 201*a* is an outlet 201*f* through which toner is discharged. As shown in FIGS. 5 and 6, the cylindrical section 201 has a circumferential surface having a region, located near the top end portion 201*a*, which is covered with the retaining member 300. Therefore, FIGS. 5 and 6 do not show the outlet 201*f*.

Meanwhile, the cylindrical section 201 has a rear end portion 201*b*, located opposite the top end portion 201*a*, which is provided with an opening portion 201*i*. Moreover, the opening portion 201*i* is closed by a cap 800. Note that the opening portion 201*i* has an outer circumference provided with a thread, and the cap 800 has an inner circumference provided with a groove. Moreover, the opening portion 201*i* is closed by screwing the cap 800 onto the opening portion 201*i* with use of the thread and the groove.

The cylindrical section 201 has an outer circumferential surface provided with a plurality of groove portions 201*c* depressed toward the inside of the cylindrical section 201. Meanwhile, as shown in FIG. 7, the cylindrical section 201 has an inner circumferential surface in which regions corresponding to the groove portions 201*c* serve as protruding portions 201*h* shaped so as to protrude toward the axis Y.

The groove portions 201*c* (protruding portions 201*h*) extend in such a direction as to be slightly tilted with respect to the rotation direction Z of the toner cartridge 200, and are provided along the axis Y of the toner cartridge 200 so as be parallel with one another. That is, the protruding portions 201*h* are linearly formed on the inner circumferential surface of the cylindrical section 201 of the toner cartridge 200 so as be tilted. Moreover, the rotation of the toner cartridge 200 causes the toner to be conveyed due to force that orients the toner from the protruding portions 201*h* to the outlet 201*f*.

Further, two groove portions 201*c* (protruding portions 201*h*) that are adjacent to each other along the axis Y partially overlap each other along the axis Y. Further, two groove portions 201*c* (protruding portions 201*h*) between which a groove portion 201*c* (protruding portion 201*h*) is sandwiched along the axis Y has an identical direction as seen from the axis Y. The angle between lines respectively extending from both ends of the drawing direction of a groove portion 201*c* (protruding portion 201*h*) to the axis Y is set to be approximately 90°.

Note that the toner cartridge 200 having these protruding portions 201*h* and the groove portions 201*c* can be formed by molding or blow molding of ABS resin, PE resin, or the like.

When the toner cartridge 200 is mounted in the multifunctional apparatus 101, the toner cartridge 200 is placed in a posture shown in FIG. 5, i.e., so that the axis Y of the cylindrical section 201 becomes horizontal. Further, the toner cartridge 200 is driven to rotate on the axis Y of the cylindrical section 201 in the direction Z of FIG. 5. That is, the toner cartridge 200 is rotated clockwise as seen from the cap 800.

Figure 9:
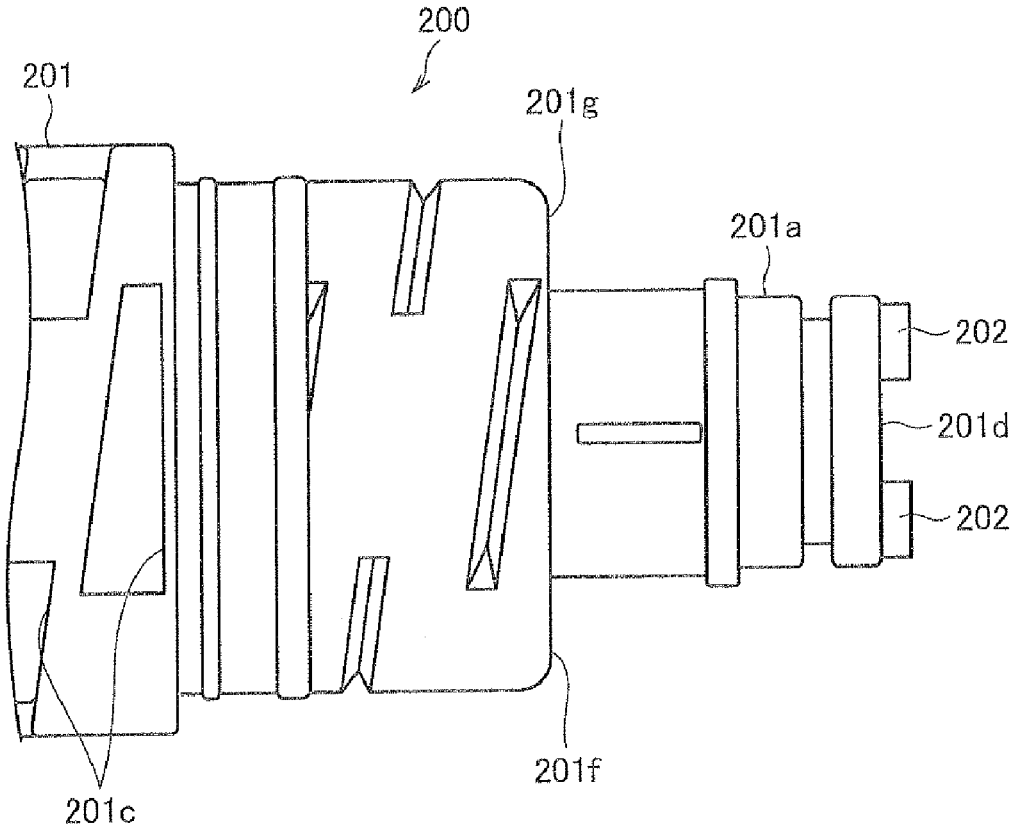
FIG. 9 is a side view of a structure of the vicinity of a top end portion of the toner cartridge.

FIG. 9 is a side view of a structure of the vicinity of the top end portion 201*a* of the toner cartridge 200. As shown in FIG. 6, the top end portion 201*a* has a cylindrical shape whose diameter is smaller than the diameter of a central portion of the cylindrical section 201. The top end portion 201*a* has a top end surface 201*d* from which two ribs 202 protrude outward.

The ribs 202 engage with a connection part of a driving device when the toner supply device 100 is mounted in the multifunctional apparatus 101. This causes the toner cartridge 200 of the toner supply device 100 to be rotated by driving force transmitted from the driving device via the ribs 202.

The cylindrical section 201 has an end face 201*g* that forms a step between the center and the top end portion 201*a*. Provided on the end face 201*g* is the outlet 201*f* through which the toner contained in the cylindrical section 201 is discharged. The toner discharged from the outlet 201*f* is stored in the holding member 300 provided so as to cover an outer circumferential surface near the top end portion 201*a*.

As shown in FIG. 8, provided on a bottom surface of the holding member 300 (surface that faces down when the toner supply device 100 is mounted in the multifunctional apparatus 101) is a shutter 400 for opening and closing a toner discharging section through which the toner discharged from the toner cartridge 200 is further discharged out of the holding member 300.

That is, when the shutter 400 opens the toner discharging section of the holding member 300, the toner is supplied from the toner supply section 500 to the developing device 23 through the toner conveying path 612.

As shown in FIGS. 4 through 6 and 8, the holding member 300 is shaped into a cylinder both ends of which are open, and is constituted by a first housing 301 and a second housing 301 that are joined to each other so as to cover the outer circumferential surface near the top end portion 201*a* of the cylindrical section 201. The holding member 300 has an end that is provided with an opening from which the ribs 202 provided on the top end surface 201*d* of the top end portion 201*a* are at least exposed.

As shown in FIG. 8, provided on a surface of the second housing 302 so to be parallel with each other are guide members 303 and 304 for placing the toner supply device 100 in the multifunctional apparatus 101.

Provided between the guide members 303 and 304 is the aforementioned shutter 400 that carries out such a control operation that the toner supplied from the toner supply device 100 is discharged outward. For this reason, the guide members 303 and 304 are at such a level that the clearance between the holding member 300 and an installation surface of the multifunctional apparatus 101 is ensured. This allows the shutter 400 to function.

Figure 10:
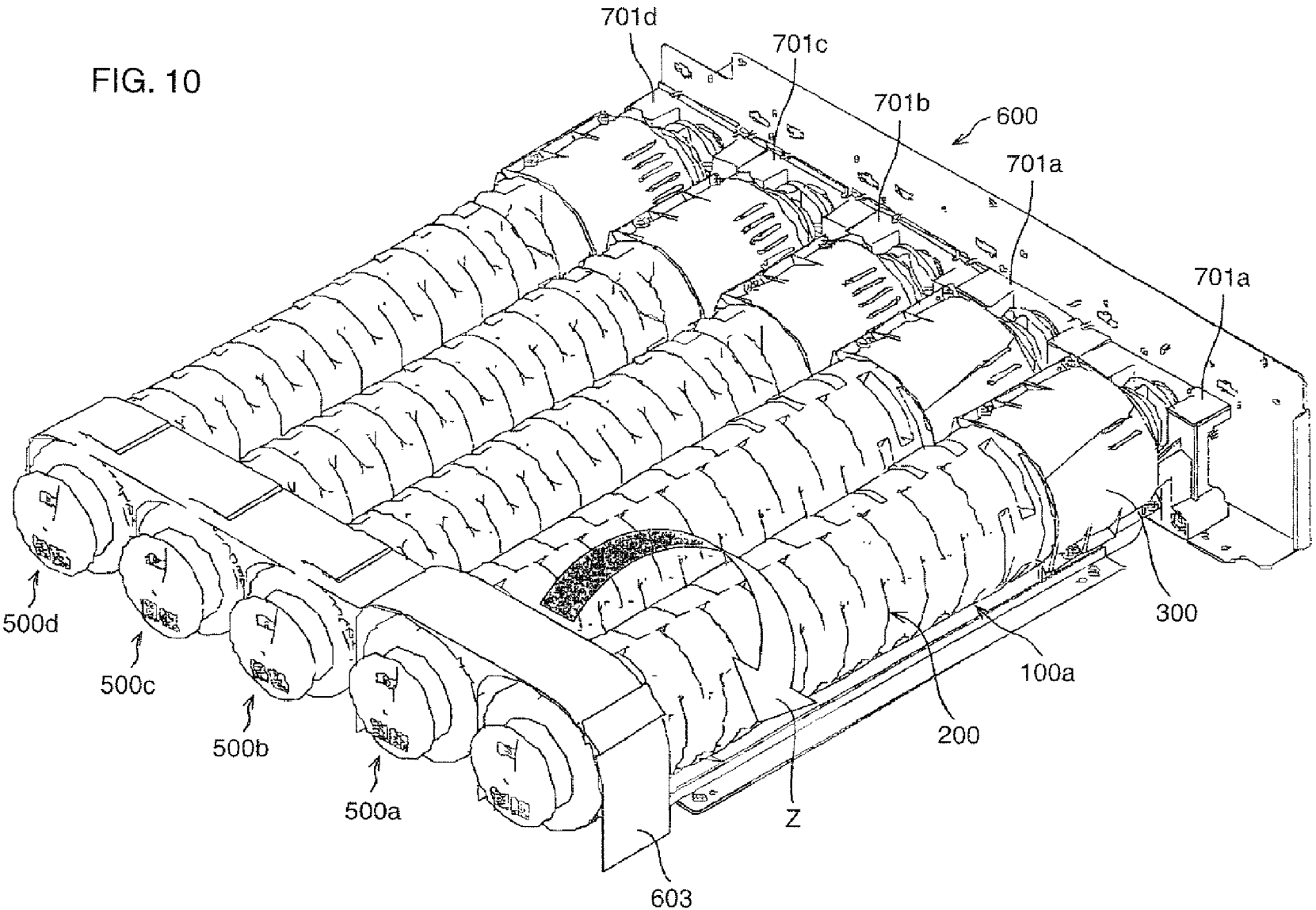
FIG. 10 is a perspective view showing how toner supply sections have been mounted in a supporting member.

FIG. 10 is a perspective view showing how the toner supply sections 500*a* to 500*d* are mounted in the supporting member 600. As shown in FIG. 10, the black toner supply sections 500*a*, the cyan toner supply section 500*b*, the magenta toner supply section 500*c*, and the yellow toner supply section 500*d* can be mounted in the supporting member 600.

It should be noted here that the toner cartridge 200 is mounted in the supporting member 600 by a holding belt 603. Note that the holding belt 603 causes the toner cartridge 200 to be mounted in the supporting member 600 at such an appropriate strength that the toner cartridge 200 can be rotated.

As shown in FIG. 10, provided on the side of the top end portion 201*a* of the toner cartridge 200 are a driving motor 701 and a connection part (not shown) for transmitting the torque of the driving motor 701 to the toner cartridge 200. The connection part has an end, facing the toner cartridge 200, which is provided with two depressions that engage with the ribs 202 provided in the toner cartridge 200. Meanwhile, the other end of the connection part is connected to the driving motor 701. With this arrangement, when the driving motor 701 rotates on the axis Y in the direction Z, the torque is transmitted to the toner cartridge 200 through the connection part, so that the toner cartridge 200 is driven to rotate on the axis Y in the direction Z.

When the toner cartridge 200 is driven to rotate on the axis Y in the direction Z, the protruding portions 201*h* provided on the inner circumferential surface of the cylindrical section 201 of the toner cartridge 200 causes the toner to be conveyed from the toner cartridge 200 to the top end portion 201*a* and then to be discharged from the outlet 201*f* into the holding member 300. Then, the toner discharged into the holding member 300 is further discharged from the toner discharging section provided with the shutter 400, and then is supplied to the developing device 23 through the toner conveying path 612.

(Residual Toner Preventing Mechanism)

Figure 11:
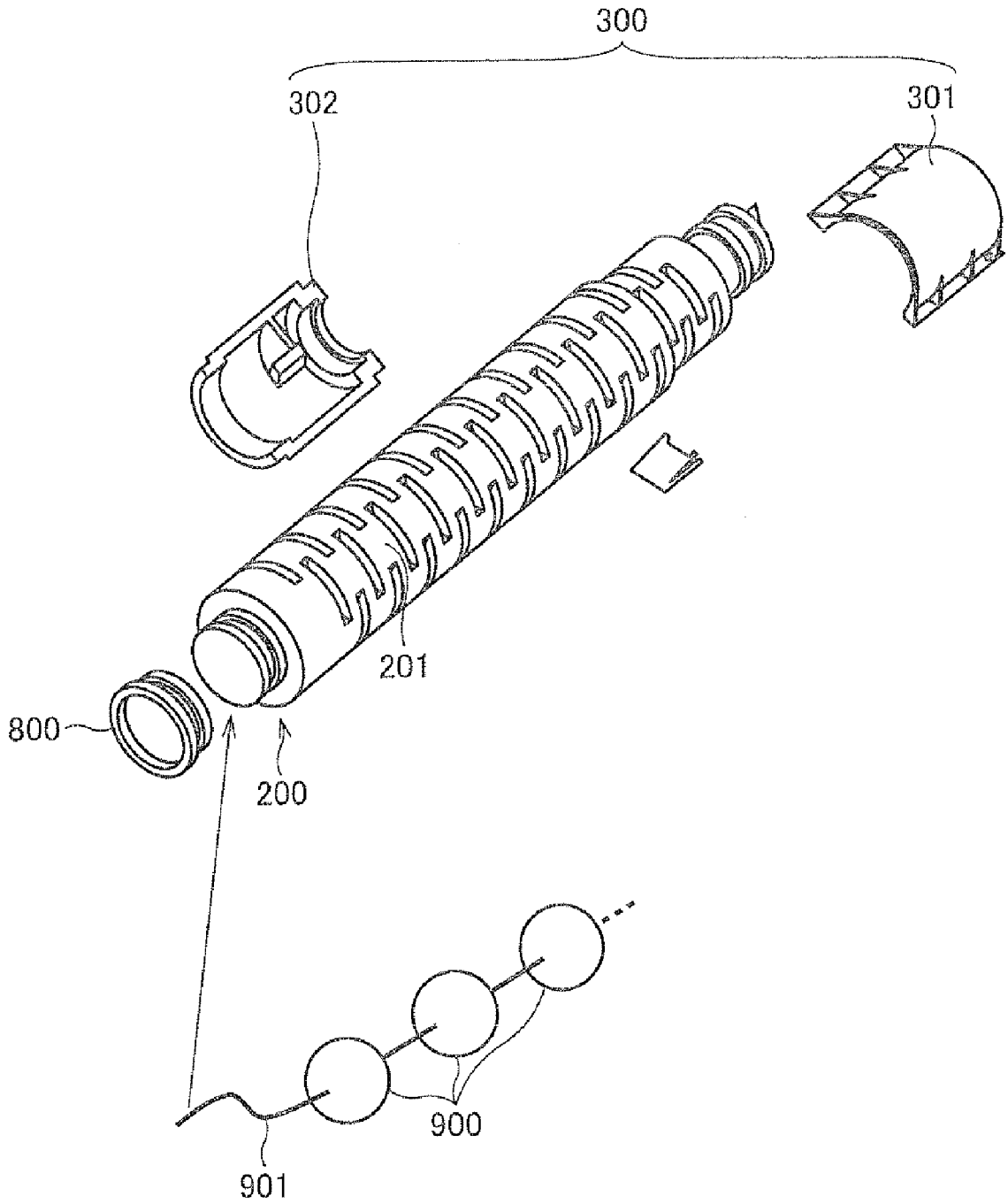
FIG. 11 is a diagram showing how a toner supply section is assembled.

The following explains a residual toner preventing mechanism of the toner cartridge 200 of the present embodiment. FIG. 11 is a diagram showing how the toner supply section 500 is assembled.

As shown in FIG. 11, the toner cartridge 200 contains a plurality of vibrating members 900 linked together by a linking member (e.g., a piano wire) 901, and the cap 800 is tightened so that one end of the linking member 901 is sandwiched between the cap 800 and the opening portion 201*i*. Furthermore, the toner cartridge 200 is held by the holding member 300. This is how the toner supply section 500 is assembled.

Figure 1:
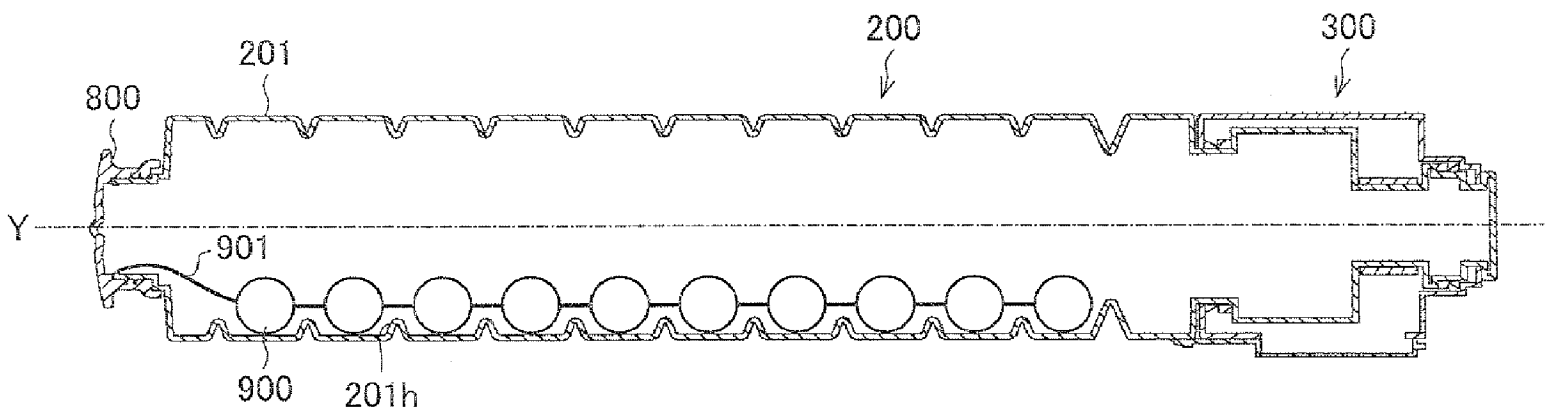
FIG. 1 is a cross-sectional view of a toner supply section having a toner cartridge in which vibrating members are disposed.

FIG. 1 is a cross-sectional view of a toner supply section 500 having a toner cartridge 200 in which vibrating members 900 are disposed. As shown in FIG. 1, each of the vibrating members 900 linked together by the linking member 901 is located between protruding portions 201*h* formed in the same direction as seen from the axis Y. Further, since only one end of the linking member 901 is fixed between the cap 800 and the cylindrical section 201 of the toner cartridge 200, the vibrating members 900 can move in the toner cartridge 200.

Each of the vibrating members 900 has a spherical shape, and has a true specific gravity greater than the true specific gravity of the toner. The vibrating members 900 can be made, for example, of stainless steel, copper, and glass.

Figure 12:
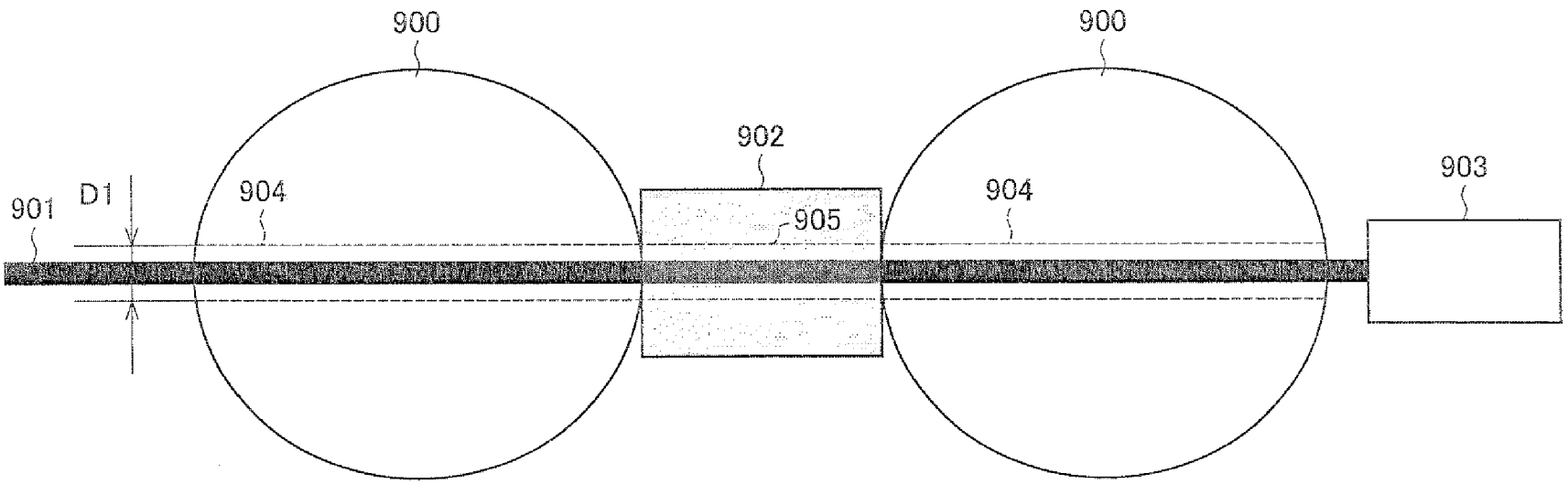
FIG. 12 is a diagram showing how the vibrating members are linked together.

FIG. 12 is a diagram showing how the vibrating members 900 are linked together. As described above, the vibrating members 900 are linked together by the linking member 901.

The linking member 901 is a linear member. Examples of the linking member 901 include: a piano wire, which is a high-carbon steel wire having a carbon content of 0.60% to 0.95%; a hard steel wire; and a stainless steel wire.

As shown in FIG. 12, each of the vibrating members 900 is provided with a first through hole 904 (e.g., having a diameter D1 of 1 mm) through which the linking member 901 passes. Furthermore, disposed between adjacent vibrating members 900 is a cylindrical spacing member 902 provided with a second through hole 905 through which the linking member 901 can pass. The spacing member 902 has an outer diameter greater than the diameter of the first through hole 904 of the vibrating member 900 (e.g., an outer diameter of 3 mm). Since the spacing member 902 is disposed, the distance between the adjacent vibrating members 900 is kept constant. The spacing member 902 is made, for example, of silicon resin, but is not limited to this.

Further, that end of the linking member 901 which is opposite to the end that is tightened on the cylindrical section 201 by the cap 800 is connected to a stopper member 903 that is larger than the first through hole 904 of the vibrating member 900. This prevents the vibrating member 900 and the spacing member 902 from being displaced from the linking member 901.

Examples of the stopper member 903 may include a gem clip as long as they can prevent the vibrating members 900 from dropping.

Figure 13:
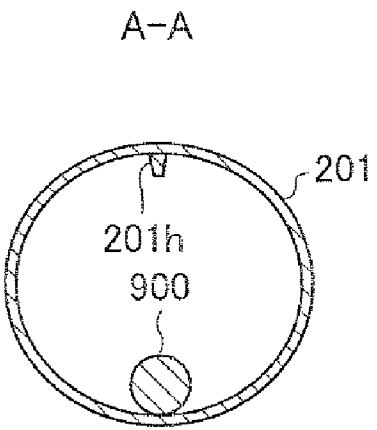
FIG. 13(*a*) is a cross-sectional view of the toner cartridge taken along the axis Y in a state (initial state) in which a point of connection between a linking member and a cap are placed downward.
Figure 13:
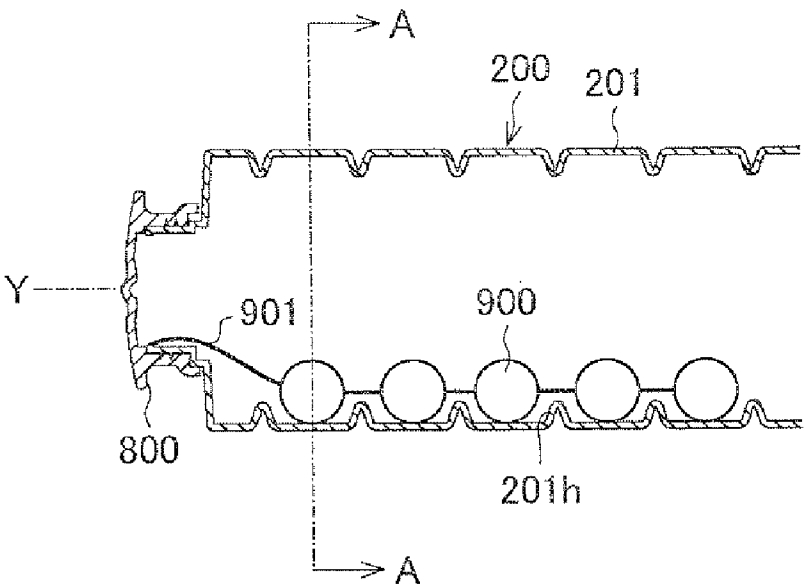

The following explains, with reference to FIGS. 13(*a*) through 16(*b*), how the vibrating members 900 move when the toner cartridge 200 is rotated.

FIG. 13(*a*) is a cross-sectional view of the toner cartridge taken along the axis Y in a state (initial state) in which a point of connection between the connecting member 901 and the cap 800 are placed downward. Further, FIG. 13(*b*) is a cross-sectional view of the toner cartridge 200 taken along the arrow A of FIG. 13(*a*).

Figure 14:
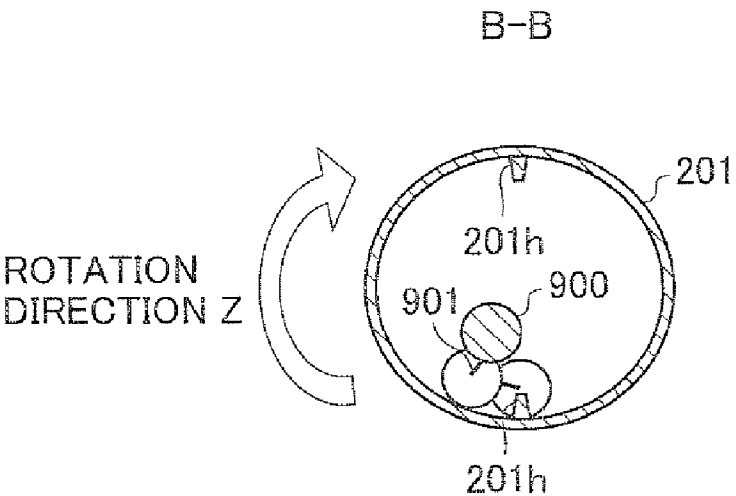
FIG. 14(*a*) is a cross-sectional view of the toner cartridge taken along the axis Y when the toner cartridge is rotated 90° with respect to the initial state.
Figure 14:
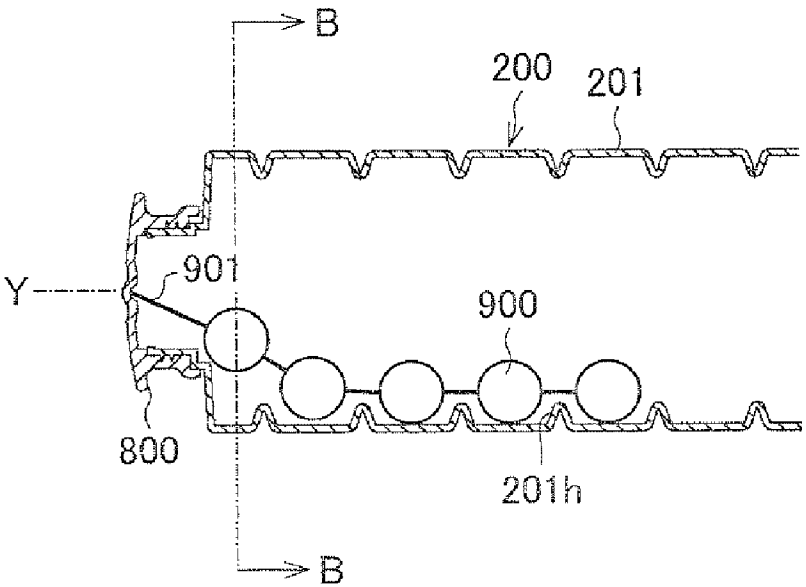

FIG. 14(*a*) is a cross-sectional view of the toner cartridge 200 taken along the axis Y when the toner cartridge 200 is rotated 90° with respect to the initial state. Further, FIG. 14(*b*) is a cross-sectional view of the toner cartridge 200 taken along the arrow B of FIG. 14(*a*).

Figure 15:
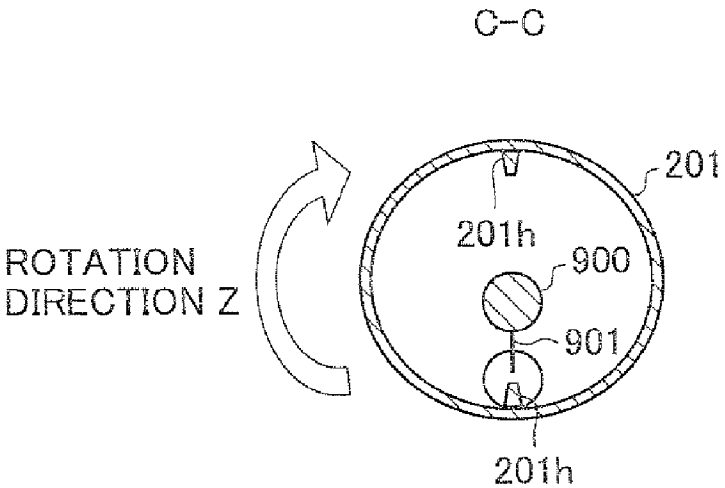
FIG. 15(*a*) is a cross-sectional view of the toner cartridge taken along the axis Y when the toner cartridge is rotated 180° with respect to the initial state.
Figure 15:
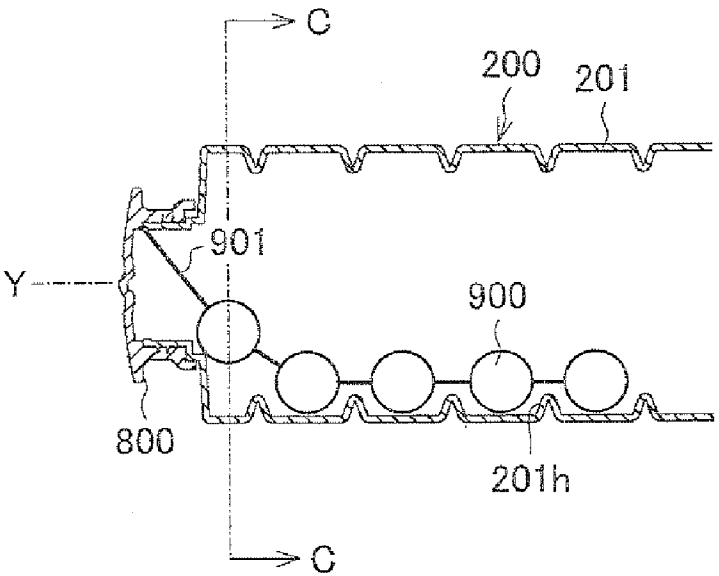

FIG. 15(*a*) is a cross-sectional view of the toner cartridge 200 taken along the axis Y when the toner cartridge 200 is rotated 180° with respect to the initial state. Further, FIG. 15(*b*) is a cross-sectional view of the toner cartridge 200 taken along the arrow C of FIG. 15(*a*).

Figure 16:
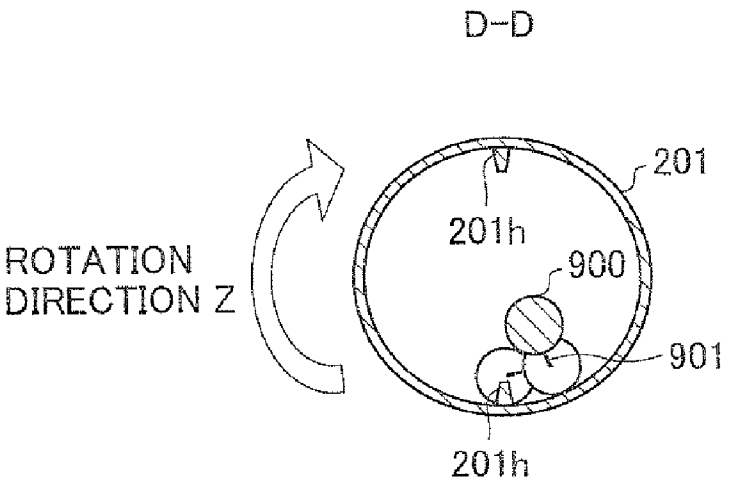
FIG. 16(*a*) is a cross-sectional view of the toner cartridge taken along the axis Y when the toner cartridge is rotated 270° with respect to the initial state.
Figure 16:
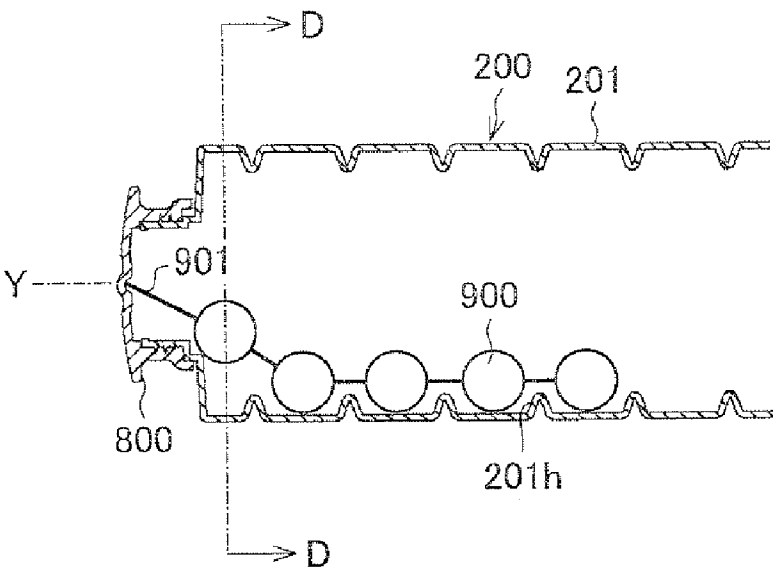

FIG. 16(*a*) is a cross-sectional view of the toner cartridge 200 taken along the axis Y when the toner cartridge 200 is rotated 270° with respect to the initial state. Further, FIG. 16(*b*) is a cross-sectional view of the toner cartridge 200 taken along the arrow D of FIG. 16(*a*).

As shown in FIGS. 13(*a*) through 16(*b*), the position of the vibrating members 900 is changed along the axis Y in accordance with the rotational position of the point of connection between the linking member 901 and the cap 800 with respect to the axis Y. This enables the vibrating members 900 to remove toner from an inner wall of the cylindrical section 201 of the toner cartridge 200 by rubbing the inner wall.

Further, although the toner is conveyed toward the outlet 201*f* by the protruding portions 201*h*, the vibrating members 900 are not moved toward the outlet 201*f* by the protruding portions 201*h*. This is because that end of the connecting member 901 which is opposite to the end at which the outlet 201*f* of the toner cartridge 200 is provided is fixed. As a result, the vibrating members 900 are always rubbed against the entire inner wall of the cylindrical section 201 of the toner cartridge 200. This improves a toner discharging effect.

Furthermore, the angle between two lines respectively extending from both ends of the drawing direction of a protruding portion 201*h* to the axis Y is set to be approximately 90°. Further, as described above, since that end of the connecting member 901 which is opposite to the end at which the outlet 201*f* of the toner cartridge 200 is provided is fixed, the vibrating members 900 are not moved toward the outlet 201*f* by the protruding portions 201*h*. For this reason, the vibrating means 900 collide with the protruding portions 201*h* when the toner cartridge 200 is rotated. This causes the vibrating members 900 to vibrate. The toner can be removed from the inner wall also by transmitting the vibration to the toner cartridge 200. This makes it possible to prevent the toner from accumulating.

Example

The following explains results obtained by evaluating, in a specific Example of the present embodiment, amounts of toner remaining in the toner cartridge 200.

Figure 17:
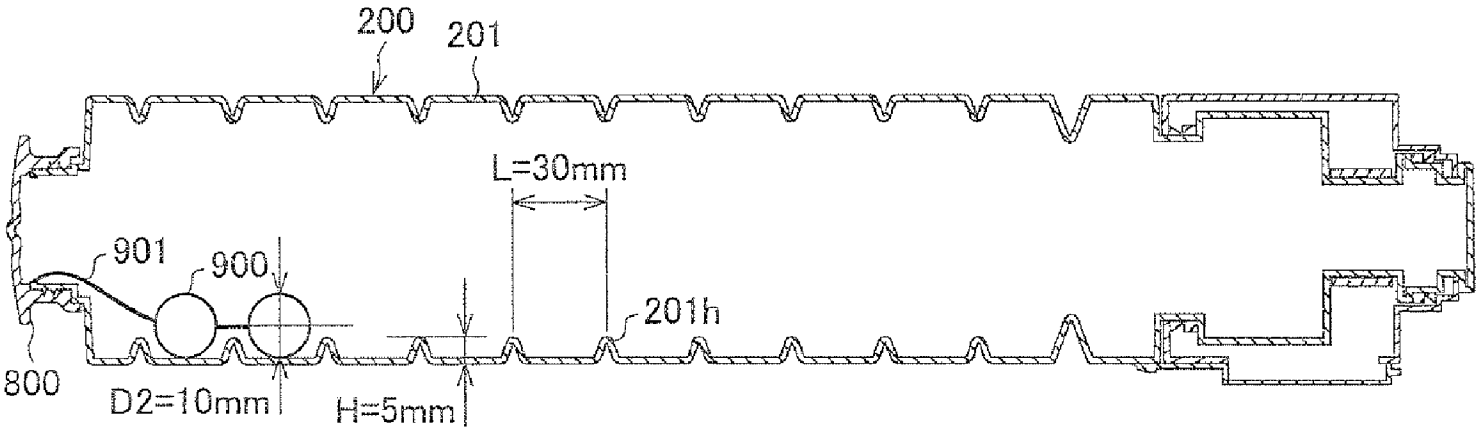
FIG. 17 is a cross-sectional view of a toner cartridge marked with the dimensions of a protruding portion and a vibrating member.

FIG. 17 is a cross-sectional view of a toner cartridge marked with the dimensions of the protruding portions 201*h* and the vibrating members 900. As shown in FIG. 17, each of the vibrating members 900 had a diameter D2 of 10 mm. Further, the vibrating members 900 were made of stainless steel. Further, the height H of the protruding portion 201*h* above the inner wall of the cylindrical section 201 was set to be 5 mm. The distance L between protruding portions disposed in the same direction as seen from the axis Y was set to be 30 mm.

Then, each of the black toner, the yellow toner, the magenta toner, and the cyan toner was poured into the toner cartridge 200, and the amount of toner remaining in the toner cartridge 200 after the toner cartridge 200 had been driven to rotate was evaluated. Note that the toner used herein is polyester toner composed mainly of polyester resin, and has a volume average particle diameter of 6.0 μm to 7.0 μm, a shape coefficient SF-1 of 125 to 135 (indicating the degree of roundness of toner particles), and a shape coefficient SF-2 of 128 to 140 (indicating the degree of unevenness of toner particles). Note that the shape coefficients are values obtained by analyzing image information by an image analysis apparatus (Luzex III; manufactured by Nireco Corporation). The image information was obtained by randomly sampling 100 toner images magnified 500 times, for example, with use of FE-SEM (S-800; manufactured by Hitachi, Ltd.). Further, the amount of toner charged into the toner cartridge 200 was 1 kg. Furthermore, an AC motor 4.2 rpm (rated 24V/62.5 Hz) was used as a driving motor for rotating the toner cartridge 200.

Further, a piano wire was used as the connecting member 901.

In Table 1, the amounts of toner remaining in the toner cartridge 200 are shown in relation to piano wires having different diameters, respectively. As shown in Table 1, a piano wire having a diameter of 0.025 mm was entwined with the vibrating members 900. This made it difficult to discharge the toner. Meanwhile, a piano wire having a diameter of not less than 0.050 mm was not entwined in such a manner. Moreover, when piano wires having a diameter of 0.050 mm to 0.300 mm were used, the remaining amount of toner became less than 30 g. This made it possible to confirm that substantially the total amount of toner can be discharged. However, it was also found that the remaining amount of toner increases when a piano wire having a diameter of not less than 0.500 mm is used. This is considered to be because the piano wire has such high stiffness (also referred to as toughness, elasticity, or tension) that vibrating members 900 close to the cap 800 do not sufficiently rub the inner wall of the toner cartridge 200.

With this, the rotation of the cylindrical section 201 causes the vibrating members 900 to vibrate the toner cartridge 200 by colliding with the protruding portions 201*h*. The vibration causes the toner to be removed from an inner wall of the cylindrical section 201, thereby improving efficiency in the discharge of the toner. Further, the vibrating members 900 can move in the cylindrical section 201. Therefore, the rotation of the cylindrical section 201 causes the vibrating members 900 to rub the inner wall of the cylindrical section 201 in a region free of protruding portions 201*h*. This also makes it possible to remove the toner from the inner wall, thereby improving efficiency in the discharge of the toner.

Moreover, the foregoing arrangement has a simple structure as compared with the conventional arrangements. That is, unlike the conventional arrangements, the foregoing arrangement does not require a rotatable spiral stirring member, a part for rotating the stirring member, and the like in addition to the cylindrical section 201. This makes it possible to manufacture the toner cartridge 200 inexpensively. Further, the simple structure makes it possible to achieve a reduction in size of the toner cartridge 200.

TABLE 1

| Piano Wire Diameter | When the toner cartridge was driven to rotate: | Amount of toner remaining in the toner cartridge | | Comprehensive Evaluation |
|---|---|---|---|---|
| 0.025 mm | the piano wire was entwined with the vibrating members. | — | | x |
| 0.050 mm | the piano wire was not entwined. | 16 g | [Evaluation Method] | ○ |
| 0.080 mm | the piano wire was not entwined. | 15 g | The circle, which represents | ○ |
| 0.100 mm | the piano wire was not entwined. | 18 g | "Good", denotes that the toner | ○ |
| 0.200 mm | the piano wire was not entwined. | 20 g | remaining amount is less than | ○ |
| 0.300 mm | the piano wire was not entwined. | 28 g | 30 g. | ○ |
| 0.500 mm | the piano wire was not entwined. | 70 g | | Δ |
| 1.0 mm | the piano wire was not entwined. | 180 g | | x |

Note that the dimensions of the protruding portions 201*h* and the vibrating members 900 can be appropriately selected. However, it is preferable that the height of the protruding portions 201*h* range from 3 mm to 8 mm. In cases where the height of the protruding portions 201*h* is less than 3 mm, it takes time to convey the toner. On the other hand, when the height of the protruding portions 201*h* exceeds 8 mm, the vibrating members 900 may not be able to smoothly move along the axis Y in the toner cartridge 200.

Further, it is preferable that the outer diameter of the vibrating members 900 range from 6 mm to 30 mm. In cases where the outer diameter of the vibrating members 900 is less than 6 mm, the number of vibrating members 900 increases. This causes an increase in cost necessary for the vibrating members 900. On the other hand, when the outer diameter of the vibrating members 900 exceeds 30 mm, the area of contact between the vibrating members 900 and the inner wall of the toner cartridge 200 becomes smaller. This causes a reduction in the toner-scraping effect of the vibrating members 900. This causes an increase in toner remaining amount.

As described above, the toner cartridge (developer storage container) 200 stores toner (developer) in a hollow cylindrical section 201 that is driven to rotate on its axis Y so that the stored toner is discharged from an outlet 201*f*. Moreover, the cylindrical section 201 has an inner circumferential surface provided with a plurality of linear protruding portions 201*h* that extend in a direction tilted with respect to a rotation direction of the cylindrical section 201. Moreover, the toner cartridge 200 includes at least one vibrating member (stirring member) 900 capable of moving in the cylindrical section 201 so as to collide with the protruding portions 201*h*.

As described above, it is preferable that the true specific gravity of the vibrating member 900 is greater than the true specific gravity of the toner. With this, even if the toner cartridge 200 contains a large amount of toner, the vibrating member 900 is located at the bottom of the toner cartridge 200. Therefore, when the cylindrical section 201 is rotated, the vibrating member 900 can rub the entire inner wall of the cylindrical section 201. This makes it possible to achieve a further reduction in the amount of toner remaining in the toner cartridge 200.

Furthermore, a plurality of such vibrating members 900 are linked together by a linking member 901. This makes it possible to dispose the plurality of vibrating members 900 along the axis Y of the cylindrical section 201, thereby causing an increase in area of contact between the vibrating members 900 and the inner wall of the cylindrical section 201. With this, the vibration caused by the collision between the protruding portions 201*h* and the vibrating members 900 can be better imparted to the toner cartridge 200. This also causes an increase in area by which the vibrating members 900 rub the inner wall of the cylindrical section 201. This makes it possible to achieve a further reduction in the amount of toner remaining in the toner cartridge 200.

Furthermore, it is preferable that the linking member 901 links the vibrating members 900 to an end 201*b* of the cylindrical section 201 at which end 201*b* the outlet 201*f* is not provided.

This prevents the vibrating members 900 from being conveyed toward the outlet 201*f* together with the toner. Therefore, the vibrating members 900 not only collide frequently with the protruding portions 201*h*, but also can rub the entire inner wall of the cylindrical section 201. This makes it possible to achieve a further reduction in the amount of toner remaining in the toner cartridge 200.

As described above, a developer storage container according to the present technology is a developer storage container storing a developer in a hollow cylindrical section that is driven to rotate on an axis thereof so that the stored developer is discharged from an outlet, the cylindrical section having an inner circumferential surface provided with a plurality of liner protruding portions that extend in a direction tilted with respect to a rotation direction of the cylindrical section, the developer storage container comprising at least one stirring member capable of moving in the cylindrical section so as to collide with the protruding portions.

According to the foregoing arrangement, the cylindrical section has an inner circumferential surface provided with a plurality of liner protruding portions that extend in a direction tilted with respect to a rotation direction of the cylindrical section. Therefore, the rotation of the cylindrical section causes the developer to be conveyed. Moreover, there exists at least one stirring member capable of moving in the cylindrical section so as to collide with the protruding portions. Therefore, the rotation of the cylindrical section causes the at least one stirring member to vibrate the developer storage container by colliding with the protruding portions. The vibration causes the toner to be removed from an inner wall of the cylindrical section. This makes it possible to improve efficiency in the discharge of the developer. Further, the at least one stirring member can move in the cylindrical section. Therefore, the rotation of the cylindrical section causes the at least one vibrating member to rub the inner wall of the cylindrical section in a region free of protruding portions. This also makes it possible to remove the developer from the inner wall, thereby improving efficiency in the discharge of the developer.

Moreover, the developer storage container thus arranged has such a simple structure that the inner circumferential surface of the cylindrical section is provided with the linear protruding portions and the cylindrical section includes the at least one stirring member. That is, unlike the conventional arrangements, the developer storage container does not require a rotatable spiral stirring member, a part for rotating the stirring member, and the like in addition to the cylindrical section. This makes it possible to manufacture the developer storage container inexpensively. Further, such a simple structure makes it possible to achieve a reduction in size of the developer storage container.

As described above, the technology makes it possible to stably supply a developer and to realize an inexpensive developer storage container whose size can be reduced.

Furthermore, the developer storage container is preferably arranged such that the true specific gravity of the at least one stirring member is greater than the true specific gravity of the developer.

According to the foregoing arrangement, even if the developer storage container contains a large amount of developer, the at least one stirring member is located at the bottom of the developer storage container. Therefore, when the cylindrical section is rotated, the at least one stirring member can rub the entire inner wall of the cylindrical section. This makes it possible to achieve a further reduction in the amount of developer remaining in the developer storage container.

Furthermore, the developer storage container is preferably arranged such that the at least one stirring member includes a plurality of stirring members linked together by a linking member.

According to the foregoing arrangement, the plurality of stirring members are linked together by the linking member. This makes it possible to dispose the plurality of stirring members along the axis of the cylindrical section, thereby causing an increase in area of contact between the vibrating members and the inner wall of the cylindrical section. With this, the vibration caused by the collision between the protruding portions and the vibrating members can be better imparted to the developer storage container. This also causes an increase in area by which the vibrating members rub the inner wall of the cylindrical section. This makes it possible to achieve a further reduction in the amount of developer remaining in the developer storage container.

Furthermore, the developer storage container is preferably arranged such that: the outlet is provided at one end of the cylindrical section; and the at least one vibrating member and an end of the cylindrical section at which end the outlet is not provided are linked to each other via a linking member.

Furthermore, the developer storage container is preferably arranged such that the at least one stirring member has a spherical shape whose diameter is not less than 6 mm and not more than 30 mm. Within this range, the at least one stirring member can move in the cylindrical section without taking a long time to convey the developer.

Furthermore, the developer storage container is preferably arranged such that each of the protruding portions has a height of not less than 3 mm and not more than 8 mm above the inner circumferential surface of the cylindrical section. Within this range, it is possible to minimize cost necessary for stirring members and to reduce the amount of developer remaining in the developer storage container.

Furthermore, the developer storage container is preferably arranged such that the linking member is a piano wire whose diameter is not less than 0.050 mm and not more than 0.300 mm. Within this range, it is possible to prevent the linking member from being entwined with the at least one stirring member and to reduce the amount of developer remaining in the developer storage container.

Further, an image forming apparatus includes such a developer storage container as described above. This makes it possible to make good use of a developer and to manufacture an inexpensive and small image forming apparatus.

The embodiments and concrete examples of implementation discussed in the foregoing detailed explanation serve solely to illustrate the technical details of the present technology, which should not be narrowly interpreted within the limits of such embodiments and concrete examples, but rather may be applied in many variations within the spirit of the technology, provided such variations do not exceed the scope of the patent claims set forth below.

What is claimed is:

1. A developer storage container, comprising:

a hollow cylindrical section that is driven to rotate on an axis thereof so that developer stored within the cylindrical section is discharged from an outlet, the cylindrical section having an inner circumferential surface provided with a plurality of liner protruding portions that extend in a direction tilted with respect to a rotation direction of the cylindrical section; and a stirring member capable of moving in the cylindrical section so as to collide with the protruding portions, the stirring member including an elongated flexible linking member, and a plurality of vibrating members that are mounted on and spaced apart along the linking member.

2. The developer storage container as set forth in claim 1, wherein the true specific gravity of the plurality of vibrating members is greater than the true specific gravity of the developer.

3. The developer storage container as set forth in claim 1, wherein:

the outlet is provided at a first end of the cylindrical section; and the linking member is attached to a second end of the cylindrical section that is opposite the first end.

4. The developer storage container as set forth in claim 3, wherein the linking member is a piano wire whose diameter is not less than 0.050 mm and not more than 0.300 mm.

5. The developer storage container as set forth in claim 1, wherein each of the plurality of vibrating members has a spherical shape whose diameter is not less than 6 mm and not more than 30 mm.

6. The developer storage container as set forth in claim 1, wherein each of the protruding portions has a height of not less than 3 mm and not more than 8 mm above an inner circumferential surface of the cylindrical section.

7. The developer storage container as set forth in claim 1, wherein the linking member is a piano wire whose diameter is not less than 0.050 mm and not more than 0.300 mm.

8. An image forming apparatus comprising the developer storage container of claim 1.

9. The developer storage container as set forth in claim 1, wherein the linking member comprises a plurality of segments that join adjacent pairs of the vibrating members.

10. The developer storage container as set forth in claim 1, wherein a through hole is formed in each of the plurality of vibrating members, and wherein the linking member passes through the through hole of each of the vibrating members to mount the vibrating members on the linking member.

11. The developer storage container as set forth in claim 10, wherein an inner diameter of the through hole in each of the vibrating members is larger than an outer diameter of the linking member such that the vibrating members are free to rotate around the linking member.

12. The developer storage container as set forth in claim 1, further comprising at least one spacing member that is mounted on the linking member between two of the vibrating members.

13. The developer storage container as set forth in claim 1, wherein the outlet is located at a first end of the cylindrical section, and wherein the stirring member is attached to the cylindrical section by a cap mounted on a second end of the cylindrical section that is opposite to the first end.

14. A developer storage container, comprising a hollow cylindrical body including:

a cylindrical outer wall, an outlet located at a first end of the cylindrical body, and a plurality of protrusions formed on the outer wall that extend into an interior of the cylindrical body, the plurality of protrusions being angled with respect to a circumference of the cylindrical outer wall such that when the cylindrical body is rotated around a longitudinal central axis, the protrusions tend to move toner inside the cylindrical body towards the outlet; and a stirring member mounted inside the hollow cylindrical body and capable of moving within the cylindrical body so as to collide with the protrusions, the stirring member including:

an elongated linking member, and a plurality of vibrating members that are mounted along the elongated linking member.

15. The developer storage container as set forth in claim 14, wherein the plurality of vibrating members are spaced apart from one another along the linking member.

16. The developer storage container as set forth in claim 15, further comprising a plurality of spacing members, wherein each spacing member is mounted on the linking member between an adjacent pair of vibrating members.

17. The developer storage container as set forth in claim 16, wherein each of the plurality of vibrating members comprises a spherical body having a diameter between approximately 6 mm and approximately 30 mm.

18. The developer storage container as set forth in claim 17, wherein each of the spacing members comprises a cylindrical body having a diameter that is smaller than a diameter of the vibrating members.

19. The developer storage container as set forth in claim 14, wherein the linking member is a wire whose diameter is not less than 0.050 mm and not more than 0.300 mm.

20. The developer storage container as set forth in claim 14, wherein the vibrating members are mounted on the linking member such that they can rotate with respect to the linking member.

* * * * *